US006620224B1

(12) United States Patent
Sato

(10) Patent No.: US 6,620,224 B1
(45) Date of Patent: Sep. 16, 2003

(54) AIR PURIFICATION DEVICE WITH A NEEDLE-SHAPED ELECTRODE HAVING A PROTECTIVE COVER THEREON

(75) Inventor: Hisashi Sato, Tokyo (JP)

(73) Assignee: Kabushiki Kaisha Circland, Tokyo (JP)

( * ) Notice: Subject to any disclaimer, the term of this patent is extended or adjusted under 35 U.S.C. 154(b) by 0 days.

(21) Appl. No.: 10/217,308

(22) Filed: Aug. 12, 2002

(51) Int. Cl.[7] ..... B03C 3/41; B03C 3/84

(52) U.S. Cl. ..... 96/83; 55/DIG. 38; 95/59; 96/51; 96/88; 96/97

(58) Field of Search ..... 96/97, 69, 83, 96/88, 51, 75, 77; 95/59; 55/DIG. 38

(56) References Cited

U.S. PATENT DOCUMENTS

| | | | | | |
|---|---|---|---|---|---|
| 2,192,249 | A | * | 3/1940 | White | 95/75 |
| 3,238,702 | A | * | 3/1966 | De Seversky | 96/45 |
| 3,768,258 | A | * | 10/1973 | Smith et al. | 60/275 |
| 4,477,263 | A | * | 10/1984 | Shaver et al. | 95/7 |
| 5,003,774 | A | * | 4/1991 | Leonard | 96/52 |
| 5,055,115 | A | * | 10/1991 | Yikai et al. | 96/59 |
| 5,518,531 | A | * | 5/1996 | Joannu | 96/55 |
| 5,538,692 | A | * | 7/1996 | Joannou | 422/121 |
| 5,667,563 | A | * | 9/1997 | Silva, Jr. | 96/50 |
| 5,843,210 | A | * | 12/1998 | Paranjpe et al. | 95/59 |
| 5,980,614 | A | * | 11/1999 | Loreth et al. | 96/63 |
| 6,004,375 | A | * | 12/1999 | Gutsch et al. | 95/57 |
| 6,193,788 | B1 | * | 2/2001 | Nojima | 96/97 |
| 6,368,392 | B1 | * | 4/2002 | Ohtake et al. | 96/65 |
| 6,464,754 | B1 | * | 10/2002 | Ford | 95/26 |
| 6,506,238 | B1 | * | 1/2003 | Endo | 96/79 |
| 6,530,981 | B2 | * | 3/2003 | Stivers | 96/44 |

FOREIGN PATENT DOCUMENTS

| | | |
|---|---|---|
| JP | Jikkai S63-103729 | 7/1988 |
| JP | Jikkai H04-110725 | 9/1992 |
| JP | 2541857 | 7/1996 |
| JP | Toakkai H10-291807 | 11/1998 |
| JP | Tokkai 2000-82567 | 3/2000 |
| JP | Tokkai 2001-80908 | 3/2001 |
| JP | Tokkai 2001-189199 | 7/2001 |

* cited by examiner

*Primary Examiner*—Richard L. Chiesa
(74) *Attorney, Agent, or Firm*—Omori & Yaguchi USA, LLC

(57) ABSTRACT

In accordance with the present invention, there is provided an air purification device including: a first electrode in the shape of a hollow cylinder having both ends open; a second electrode in the shape of a solid needle having a tip end portion of a predetermined length including a pointed tip; a dielectric member covering the second electrode except the tip end portion; and a power supply for applying a high voltage across the two electrodes in order to create a corona discharge, for generating ozone and ion wind. The dielectric material may be of any type of silicone or plastic (including epoxy) as long as it is inexpensive and easy to mold. The dielectric member is, for example, in the shape of a circular flange, providing ease of maintenance and safety measures as well as permitting effective airflow.

10 Claims, 3 Drawing Sheets

AIR PURIFICATION DEVICE WITH A NEEDLE-SHAPED ELECTRODE HAVING A PROTECTIVE COVER THEREON

FIELD OF THE INVENTION

The present invention relates to improving reliability and maintenance of an air purification device by providing a protective cover for a needle-shaped electrode used for ozone generation in the device.

BACKGROUND OF THE INVENTION

Air purification devices have been available for the purpose of purifying and deodorizing air where good air quality is demanded. Some examples of these areas are residences with asthma patients, lavatories, and clean rooms, to name a few. An air purification device is generally provided with at least two electrodes, between which a high voltage is applied to develop a corona discharge across an air gap, whereby oxygen is transformed into ozone.

Some low-cost air purification devices, mainly aimed for residential use, have a relatively simple structure comprising a needle-shaped electrode having a pointed tip and an opposite electrode in the shape of a hollow cylinder. Japanese published applications JikkaiS63-103729 and JikkaiH04-110725 disclosed such a structure, wherein the needle-shaped electrode is positioned along the cylindrical axis of the opposite electrode with the pointed tip pointing toward the opposite electrode. This type of structure has an advantage of generating ion wind from one opening to the other of the hollow cylinder with the application of a DC voltage, thus eliminating the need for a fan for diffusing ozone.

Reliability and efficiency of air purification devices, however, greatly suffer when the electrodes are exposed without protection in an offensive environment such as in the presence of ozone and corona. For example, the chemical as well as physical reactions with ozone or corona as well as the sputtering effect damage the metal surface, requiring frequent replacement of the needle-shaped electrode. Furthermore, dust or contaminants tend to collect between the two electrodes, requiring frequent cleaning that involves disassembling and reassembling the device.

Some measures taken by the prior art include the use of a detachable cartridge for one or both of the electrodes for easy cleaning, as disclosed in TokkaiH10-291807, Tokkai2001-80908, and Tokkai2000-82567, for example.

However, the additional structure such as above is primarily meant for the purpose of cleaning the inside of the opposite electrode having the shape of a hollow cylinder. Since the electric field is strong especially around the pointed tip of the needle-shaped electrode, this electrode tends to collect more dust or contaminants at the tip, requiring more frequent cleaning than the opposite electrode. To address both the dust collection problem and the degradation problem of the needle-shaped electrode, Japanese Patent 2541857 disclosed ceramic coating, preferably quartz, to protect the needle-shaped electrode. This patent relates to an ion generator that is primarily used for discharging charged particles in a clean room in semiconductor fabrication facilities. However, as noted in Tokkai2001-189199, in order to develop a corona discharge using the needle-shaped electrode coated with ceramics, the applied voltage has to be increased, thereby causing unwanted noises due to electromagnetic radiations.

In considering above circumstances surrounding the use of a needle-shaped electrode in an air purification device, we recognize that a new measure is desired to protect the needle-shaped electrode from the chemical and physical reactions with ozone and corona and from the sputtering effect, as well as to provide ease of maintenance, without drastically changing existing settings such as applied voltage values. Furthermore, the desired measure has to be cost-effective so as not to defeat the original purpose of low-cost air purification for residences. The present invention therefore addresses a new, low-cost protection means for the needle-shaped electrode to improve product reliability, while providing ease of maintenance, of air purification devices.

SUMMERY OF THE INVENTION

In accordance with the present invention, there is provided an air purification device comprising: a first electrode in the shape of a hollow cylinder having one open end and an other open end; a second electrode in the shape of a solid needle having a tip end portion of a predetermined length including a pointed tip and an other end portion, the second electrode being positioned along a cylindrical axis of the first electrode, with the pointed tip pointing toward the first electrode and the other end portion of the second electrode being outside of the one open end of the first electrode; a dielectric member covering the second electrode except the tip end portion; and a power supply for applying a high voltage across the two electrodes in order to create a corona discharge, for ozone generation and for generating ion wind that flows out through the other open end of the first electrode. The second electrode is positioned by a non-conductive holding member, which is either detachably or integrally attached to the dielectric member.

The length of the second electrode and the size and shape of the dielectric member covering the second electrode are such that a sufficient space is provided for airflow to be permitted through the one open end of the first electrode where the second electrode is positioned. The predetermined length of the tip end portion of the second electrode is in the range of 0.1 mm to 1 mm. The dielectric member is comprised of either plastic (including epoxy) or silicone.

The thickness and the shape of an end portion of the dielectric member, closest to the pointed tip are such that, in case a person touches the pointed tip with his finger, the end portion of the dielectric member prevents penetration of the tip end portion of the second electrode into the skin of the finger.

As an example of the shape of the dielectric member, there is provided a circular flange concentrically covering the second electrode except the tip end portion. The flange comprises a portion with a first diameter and a portion with a second diameter, the second diameter being larger than the first diameter, and the portion with the second diameter facing away from the first electrode.

According to one embodiment, the air purification device comprises a plurality of pairs of the first electrode and the second electrode. The second electrodes are positioned by the respective non-conductive holding members which are connected integrally; and the second electrodes are covered, except the respective tip end portions, with the respective dielectric members which are connected integrally.

BRIEF DESCRIPTION OF THE DRAWINGS

In FIGS. 2, 3, and 4, parts that are the same as those in FIG. 1 are keyed the same, and will not be explained repeatedly.

It is to be understood that the drawings are for illustrating the concepts of the present invention and are not to scale.

DETAILED DESCRIPTION OF THE PREFERRED EMBODIMENTS

Figure 1:
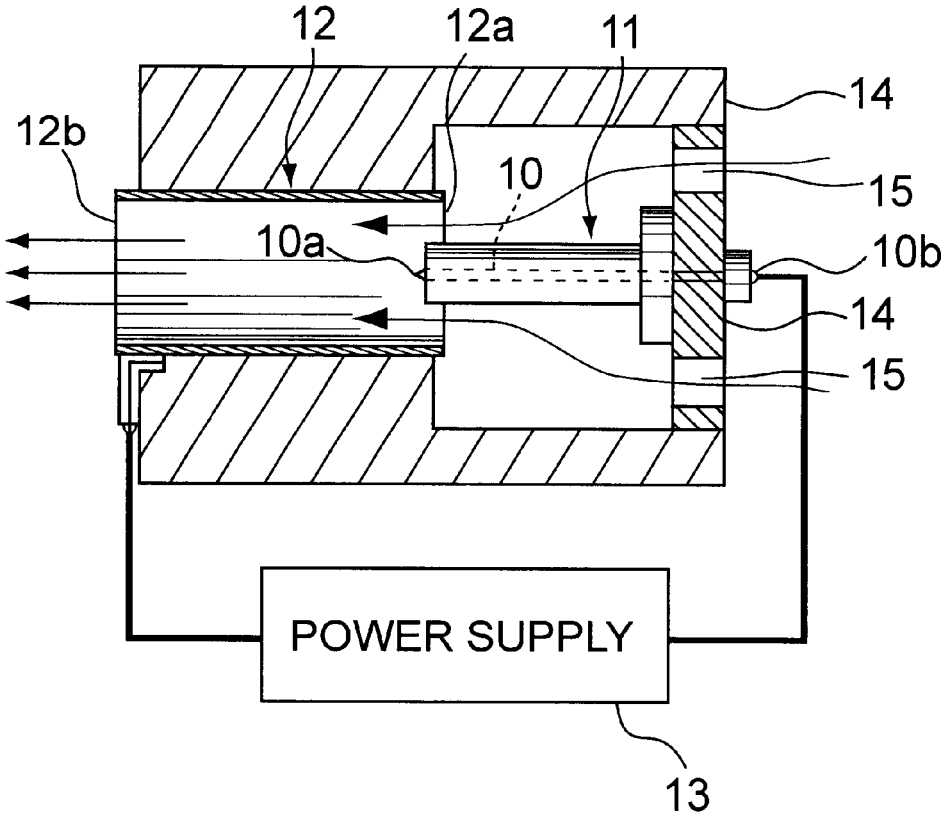
FIG. 1 is a schematic cross-sectional view of an air purification device having a needle-shaped electrode covered with a dielectric member except the tip end portion and an opposite electrode in the shape of a hollow cylinder.

FIG. 1 is a schematic cross-sectional view of an air purification device that includes a needle-shaped electrode 10, which is covered with a dielectric member 11 except a tip end portion of a predetermined length including a pointed tip 10*a*. A power supply 13 is connected to the other end portion 10*b* of the needle-shaped electrode 10 and to an opposite electrode 12. The opposite electrode 12 is in the shape of a hollow cylinder having one open end 12*a* and the other open end 12*b*. The needle-shaped electrode 10 is positioned along a cylindrical axis of the opposite electrode 12, with the pointed tip 10*a* pointing toward the opposite electrode 12 and the other end portion 10*b* of the needle-shaped electrode 10 being outside of the one open end 12*a* of the opposite electrode 12. It is preferable that the pointed tip 10*a* is inserted through the one open end 12*a* of the opposite electrode 12 as in the aforementioned JikkaiS63-103729. The needle-shaped electrode 10 is positioned as above by a non-conductive holding member 14, which may be either detachably or integrally attached to the dielectric member 11. The non-conductive holding member 14 is constructed so as to allow openings 15 sufficient for airflow, and is attached to the opposite electrode 12 for stability and for forming an outer non-conductive surface of the device.

A high voltage is applied by the power supply 13 so as to create a corona discharge between the two electrodes 10 and 12, thereby generating ozone. The power supply 13 preferably provides a DC, generating ion wind that flows out through the other open end 12*b* of the opposite electrode 12, as indicated by arrows in FIG. 1, thus eliminating the need for a fan for diffusing ozone, as noted in the aforementioned JikkaiS63-103729 and JikkaiH04-110725. It may be an AC, although in this case a means to effectively diffuse ozone, such as a fan, may have to be provided.

The purpose of covering the needle-shaped electrode 10 with the dielectric member 11, except the tip end portion, is twofold. First, at least the covered portion of the electrode is protected from ozone, corona, and ionized atoms in the air, which are known in the art to promote corrosion and deterioration of the electrode via chemical and physical reactions as well as the sputtering effect at the metal surface of the electrode. Second, the tip end portion remains exposed in order to retain electrical fields strong enough to achieve decent ozone efficiency without adjusting the existing applied voltage value and other power supply parameter values.

The length of the needle-shaped electrode 10 and the size and shape of the dielectric member 11 are such that a sufficient space is provided for airflow to be permitted through the one open end 12*a* of the opposite electrode 12, as indicated by arrows in FIG. 1, where the needle-shaped electrode 10 is positioned. Preferably, the length of the needle-shaped electrode 10 is 10 mm, the diameter of the open ends 12*a* and 12*b* of the opposite electrode 12 is 23 mm, and the thickness of the thickest portion of the dielectric member 11 is 5 mm.

Figure 2:
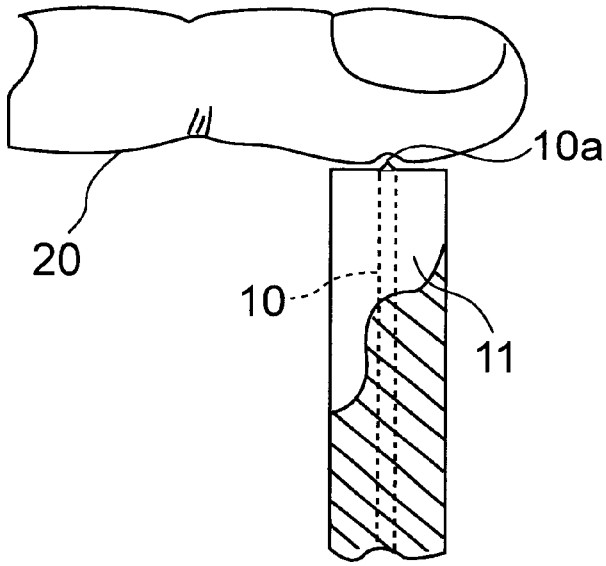
FIG. 2 illustrates that the thickness and the shape of an end portion of the dielectric member are such that, in case a person touches the pointed tip with his finger, the end portion of the dielectric member prevents penetration of the tip end portion into the skin of the finger.

Safety measures against injuries can be easily taken with the present structure of the needle-shaped electrode 10 covered with the dielectric member 11. The length of the tip end portion, which is exposed, is in the range of 0.1 mm to 1 mm, so that even when a person handling the electrode pricks his finger on the pointed tip of the needle, a deep penetration of the needle into the skin of the finger can be avoided. In addition, as illustrated in FIG. 2, the thickness and the shape of an end portion of the dielectric member 11, closest to the pointed tip 10*a* are such that, in case a person touches the pointed tip 10*a* with his finger 20, the end portion of the dielectric member 11 prevents penetration of the tip end portion into the skin of the finger 20.

Figure 3:
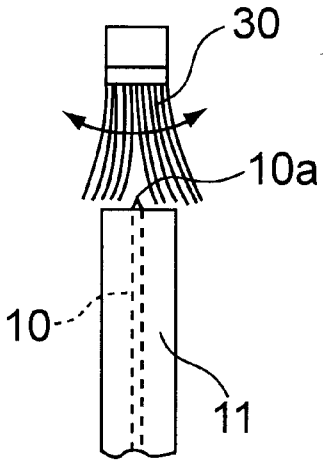
FIG. 3 illustrates that the tip end portion of the needle-shaped electrode is being cleaned by a brush.

FIG. 3 illustrates an actual cleaning situation wherein the device is disassembled and the tip end portion of the needle-shaped electrode 10 is being cleaned by a brush 30.

As an example of the shape of the dielectric member 11, FIG. 1 shows a circular flange concentrically covering the needle-shaped electrode 10 except the tip end portion. The flange comprises a portion with a first diameter and a portion with a second diameter, the second diameter being larger than the first diameter. The portion with the second diameter of the flange is positioned facing away from the opposite electrode 12, giving enough clearance for airflow. Preferably, the first diameter is 6 mm and the second diameter is 10 mm.

The dielectric material is selected from any type of silicone or plastic (including epoxy), as long as the selected material is inexpensive and is easy to mold. The flange, for example, may be pre-molded with a thin bore extending therethrough, for the needle-shaped electrode to be inserted for press fit.

Figure 4:
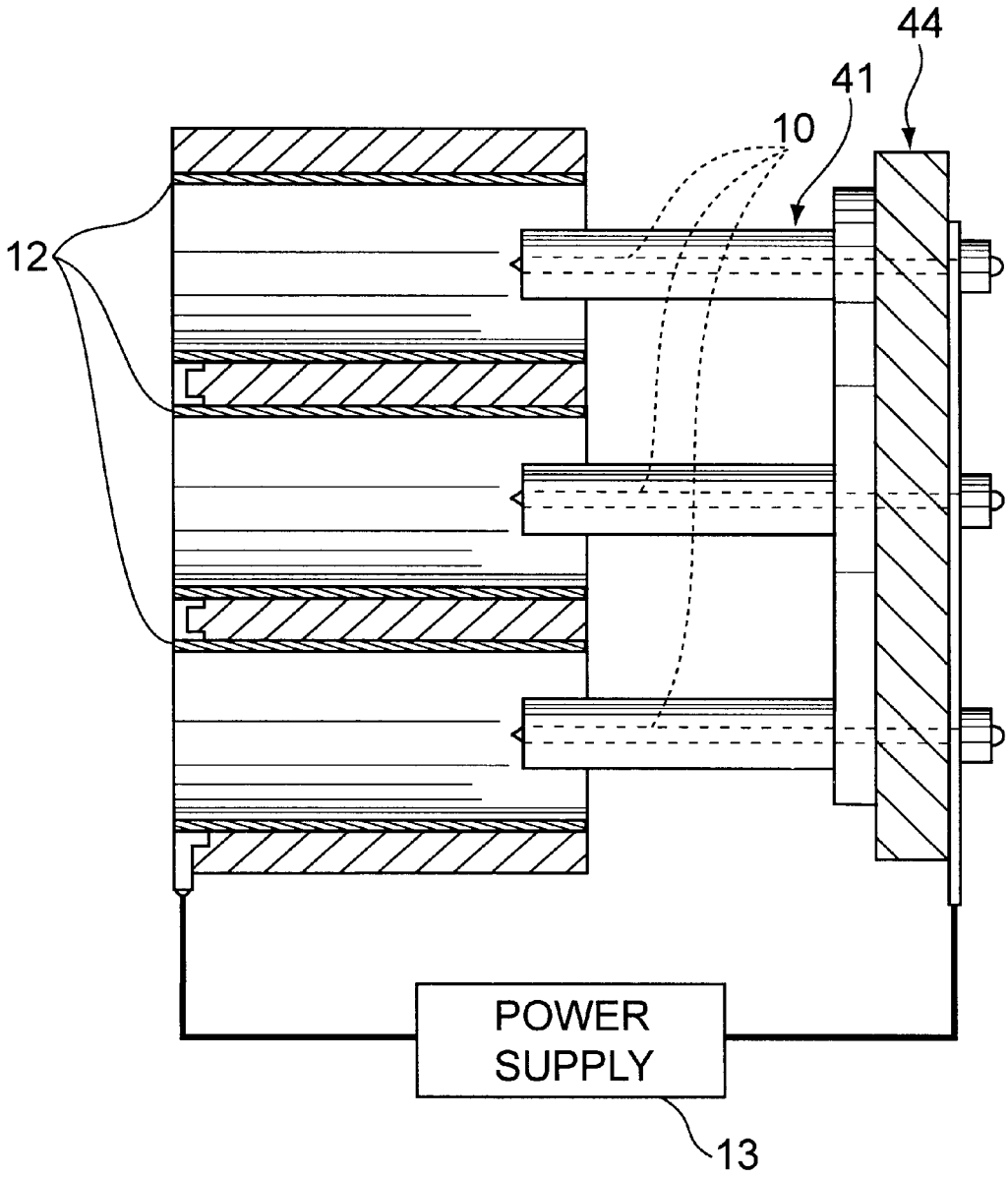
FIG. 4 is a schematic cross-sectional view of an air purification device comprising a plurality of pairs of the needle-shaped electrode and the opposite electrode.

FIG. 4 shows one embodiment, wherein the air purification device comprises a plurality of pairs of the needle-shaped electrode 10 and the opposite electrode 12 in the shape of a hollow cylinder. All the needle-shaped electrodes 10 are positioned by the respective non-conductive holding members which are connected integrally as shown by Key 44. All the needle-shaped electrodes 10 are covered, except the respective tip end portions of a predetermined length, with the respective dielectric members which are connected integrally as shown by Key 41. The continuous dielectric member 41 and the continuous non-conductive holding member 44 are detachably attached, providing ease of disassembling and reassembling the device for cleaning and other maintenance purposes.

In summary, the dielectric cover for the needle-shaped electrode as described in the present invention provides a low-cost protection means for the needle-shaped electrode against an offensive environment in an air purification device, while providing ease of maintenance and safety measures, thereby improving overall product reliability.

It is to be understood that the above-described embodiments are illustrative of only a few of the many possible specific embodiments which can represent applications of the principles of the invention. Numerous and varied other arrangements can be readily devised by those skilled in the art without departing from the spirit and scope of the invention.

What is claimed is:

1. An air purification device comprising:

a first electrode in the shape of a hollow cylinder having one open end and an other open end;

a second electrode in the shape of a solid needle having a tip end portion of a predetermined length including a pointed tip and an other end portion, said second electrode being positioned along a cylindrical axis of said first electrode, with the pointed tip pointing toward said first electrode and the other end portion of said second electrode being outside of the one open end of said first electrode;

a dielectric member covering said second electrode except the tip end portion; and a power supply for applying a high voltage across the two electrodes in order to create a corona discharge, for ozone generation and for generating ion wind that flows out through the other open end of said first electrode.

2. The air purification device according to claim 1, wherein the length of said second electrode and the size and shape of said dielectric member covering said second electrode are such that a sufficient space is provided for airflow to be permitted through the one open end of said first electrode where said second electrode is positioned.

3. The air purification device according to claim 2, wherein said second electrode is positioned by a non-conductive holding member, which is detachably attached to said dielectric member.

4. The air purification device according to claim 3, wherein said air purification device comprises a plurality of pairs of said first electrode and said second electrode;

said second electrodes are positioned by the respective non-conductive holding members which are connected integrally; and said second electrodes are covered, except the respective tip end portions of a predetermined length, with the respective dielectric members which are connected integrally.

5. The air purification device according to claim 2, wherein said predetermined length of the tip end portion of said second electrode is in the range of 0.1 mm to 1 mm.

6. The air purification device according to claim 2, wherein the thickness and the shape of an end portion of said dielectric member, closest to the pointed tip are such that, in case a person touches the pointed tip with a finger, said end portion of the dielectric member prevents penetration of the tip end portion of the second electrode into the skin of the finger.

7. The air purification device according to claim 2, wherein said second electrode is positioned by a non-conductive holding member, which is integrally attached to said dielectric member.

8. The air purification device according to claim 2, wherein said dielectric member is in the shape of a circular flange concentrically covering said second electrode except the tip end portion of a predetermined length; and said flange comprises a portion with a first diameter and a portion with a second diameter, the second diameter being larger than the first diameter, and the portion with the second diameter facing away from said first electrode.

9. The air purification device according to claim 2, wherein said dielectric member is comprised of plastic.

10. The air purification device according to claim 2, wherein said dielectric member is comprised of silicone.

* * * * *